United States Patent [19]

Wass et al.

[11] Patent Number: 4,867,347

[45] Date of Patent: Sep. 19, 1989

[54] DISPENSER PUMP

[75] Inventors: Anthony Wass, Stamford; Brian Law, Leicester, both of Great Britain

[73] Assignee: The English Glass Company Limited, United Kingdom

[21] Appl. No.: 133,076

[22] Filed: Dec. 15, 1987

[30] Foreign Application Priority Data

Dec. 16, 1986 [GB] United Kingdom ..... 8629982

[51] Int. Cl.[4] ..... B67D 5/40

[52] U.S. Cl. ..... 222/153; 222/207; 222/383; 222/384

[58] Field of Search ..... 222/207, 209, 212, 383, 222/153, 384; 92/34, 36, 89, 90

[56] References Cited

U.S. PATENT DOCUMENTS

| | | | |
|---|---|---|---|
| 2,884,164 | 4/1959 | Kleid | 222/207 |
| 3,029,742 | 4/1962 | Curtis | 222/207 |
| 3,130,877 | 4/1964 | Miller | 222/207 |
| 3,162,333 | 12/1964 | Davidson | 222/207 |
| 3,452,905 | 7/1969 | Micallef | 222/207 |
| 3,507,586 | 4/1970 | Gronemeyer et al. | 222/207 X |
| 3,680,986 | 8/1972 | Kutik et al. | 222/384 X |
| 3,753,518 | 8/1973 | Kutik | 222/383 |
| 3,785,532 | 1/1974 | Cooprider | 222/383 X |
| 3,828,985 | 8/1974 | Schindler | 222/209 X |
| 4,162,746 | 7/1979 | Anderson et al. | 222/153 |
| 4,474,314 | 10/1984 | Roggenburg, Jr. | 222/153 X |

FOREIGN PATENT DOCUMENTS

| | | |
|---|---|---|
| 1414637 | 11/1975 | United Kingdom . |
| 1459961 | 12/1976 | United Kingdom . |

*Primary Examiner*—Kevin P. Shaver

*Attorney, Agent, or Firm*—Stevens, Davis, Miller & Mosher

[57] ABSTRACT

A dispenser pump comprises a pump chamber having a flexible wall for altering the volume of the chamber. The flexible wall is a polygonal pyramid, preferably five-sided, with facets interupted by respective cylindrical surface portions inclined to the facet so as to induce bending thereof when the wall is flexed on actuation of the pump, thereby producing a force tending to restore the flexible wall to its rest condition. An inoperative condition of the pump may be achieved by relative rotation of two body parts of the pump about the axis of a slidable telescopic guide connection between the flexible wall and a relatively fixed body part, a discharge nozzle of the pump being out of register with an outlet port of the pump in the inoperative condition. The flexible wall, an essentially rigid boundary portion thereof, an essentially rigid guide member that moves with it and the discharge nozzle may be formed together as a one-piece integral part of e.g. polypropylene.

15 Claims, 5 Drawing Sheets

Fig.1.
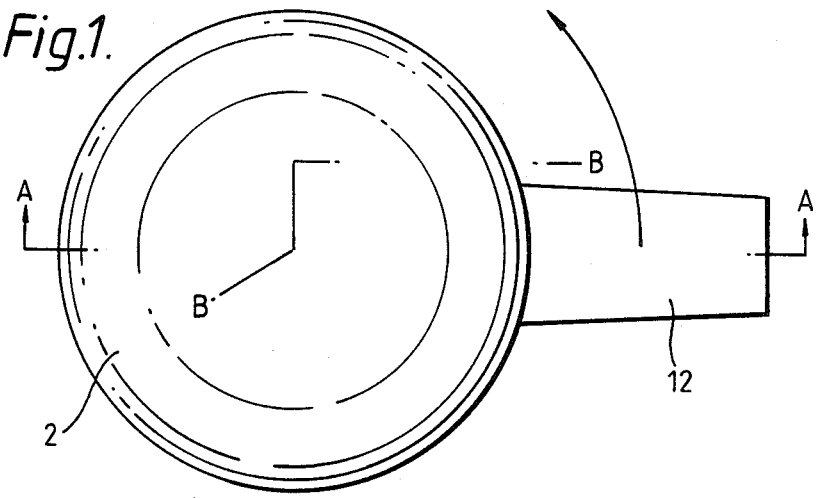
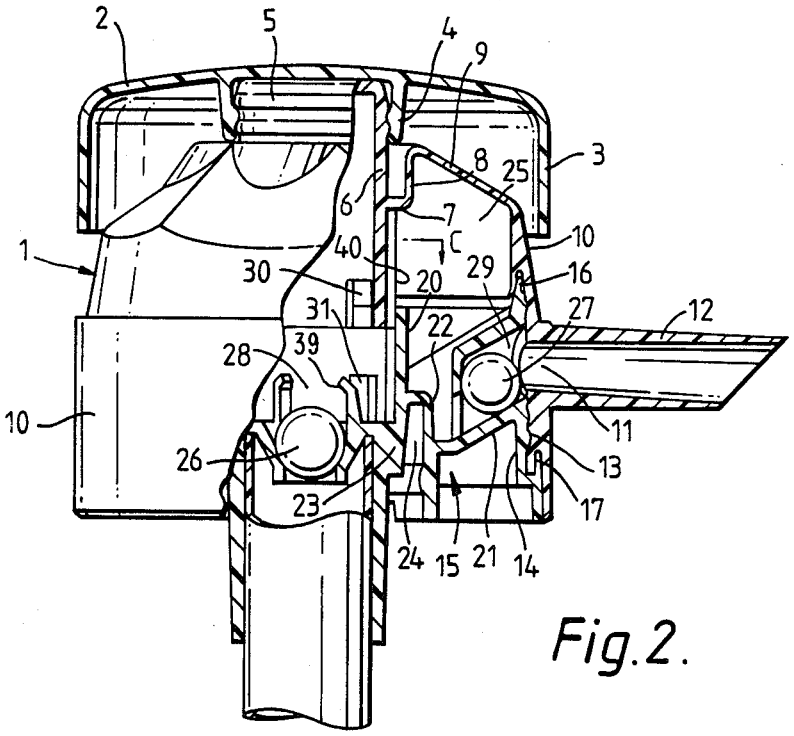
Fig.2.

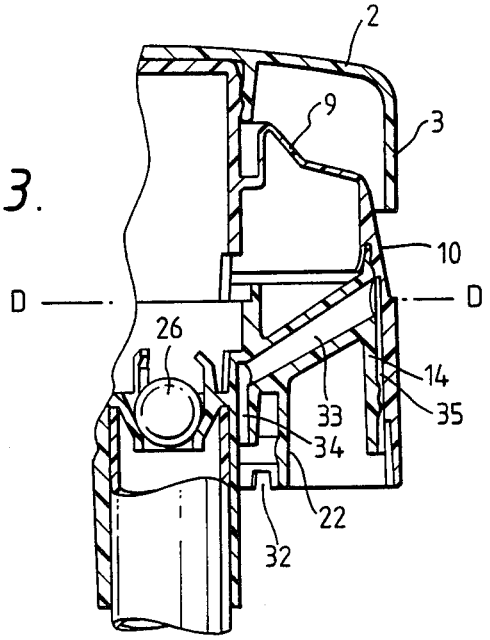
Fig.3.
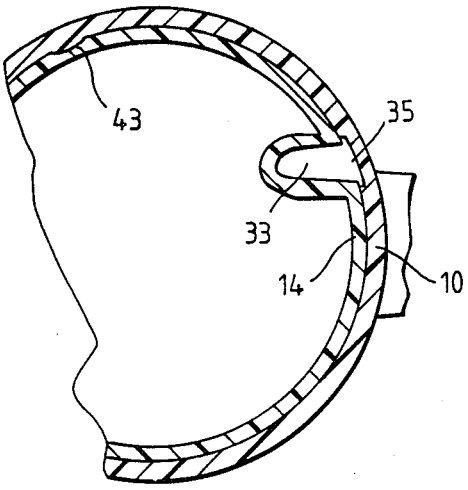
Fig.4.
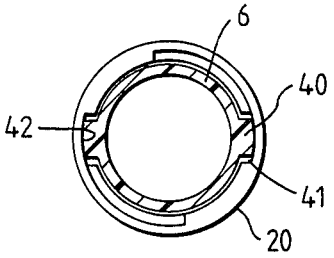
Fig.5.
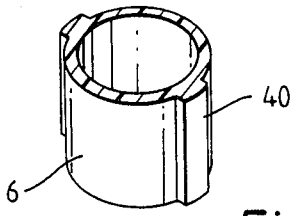
Fig.6.
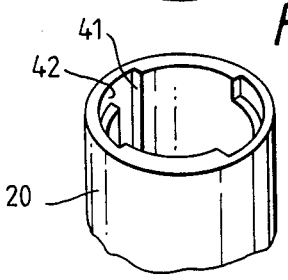

Fig.7.
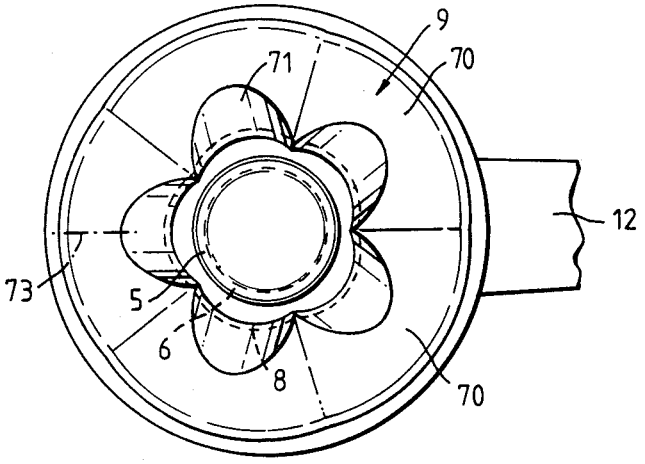
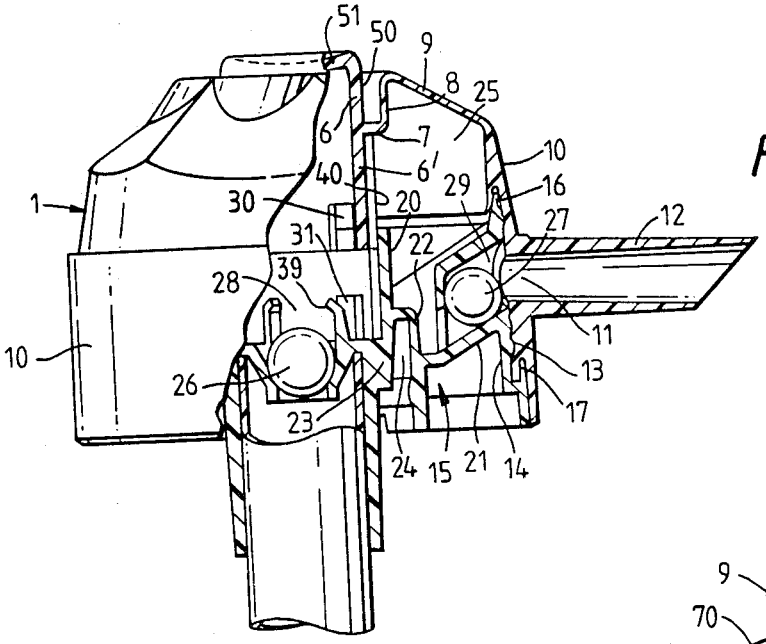
Fig.8.
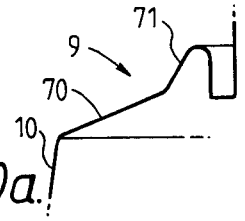
Fig.10a.
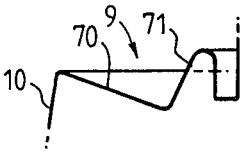
Fig.10b.

DISPENSER PUMP

FIELD OF THE INVENTION

This invention relates to dispenser pumps, and to containers incorporating such pumps.

BACKGROUND OF THE INVENTION

Dispenser pumps, which dispense as a result of manual actuation of a part of the pump (and which are to be distinguished from valves which merely release pressurized contents such as an aerosol) from a container to which they are fitted, are conventionally made with a piston working inside a cylinder so that relative displacement of the piston in the cylinder either on an inward stroke or a release stroke will cause the discharge of material in a more or less accurately measured amount.

These pumps are comparatively cheap and in many cases disposable assemblies and the fewer number of parts they can be made of, the better. Particularly this is true in relation to parts such as pistons and cylinders which are necessarily separate and which undergo relative sliding movement.

In the present invention we avoid the use of a piston and cylinder, relying instead on a specially designed flexible wall of a pump chamber of the dispenser to cause the necessary volume change of that chamber when the pump is actuated.

This as such is not new. U.S. Pat. No. 3 029 742 (Curtis) for example describes a pump that has a deformable conical diaphragm with edge flaps acting as valve elements, using a separate spring assembly to restore the diaphragm to its expanded rest position after each stroke. U.S. Pat. No. 3 452 905 (Leeds & Micallef) shows a pump with a chamber partly defined by a dome-shaped flexible portion, which likewise relies on a spring for restoration. There are however problems with these flexible wall dispensers which so far have not been solved. Amongst these is the problem of conserving the maximum chamber volume through which there is displacement within the confines of the necessarily limited diameter of these objects; another is procuring the necessary restoration forces within the flexible wall to cause it to return to its rest position after each actuation without the need for a separate restoring spring. As mentioned above, the fewer the parts constituting the pump, the better. All these aims should therefore preferably be carried out while permitting the flexible wall to be made of the same material as forms other portions of the pump, since otherwise the flexible wall would have to be a special moulding, separately assembled with the dispenser.

A further problem concerns possible leakage into or out of a container fitted with such a dispenser pump when it is being sent out from the factory. The container may be laid on its side, inverted and shaken during its transport, but during this time must not leak contents. Nevertheless, provision must be made when the dispenser is in its working condition not only for the material to be dispensed freely through a discharge nozzle, but also preferably for displacement air to be vented back into the container through the pump.

SUMMARY OF THE INVENTION

In one aspect the present dispenser pump comprises a pump chamber the volume of which can be altered by flexion of a wall thereof using actuation means of the pump and restored by restoration of that wall to its rest condition. The flexible wall, an essentially rigid boundary portion of the part of the dispenser pump with which the wall is integrally formed, an essentially rigid central guide means for guiding the movement of the wall to alter the volume of the pump chamber, a pump portion having a discharge nozzle wherethrough dispensed liquid passes out to the exterior of the pump, and preferably also a pump portion having a channel, groove or port for venting air from the pump exterior to the interior of a container from which liquid is to be dispensed are all formed together as a one-piece integral whole of the same material. A preferred material is polypropylene which is a conventional and cheap material for the moulding of pump parts for this material.

It is desirable to use a conformation of the flexible wall specially adapted to achieve this economy of parts. In another aspect, therefore, the invention provides a dispenser pump comprising a pump chamber having a wall flexible from a rest condition upon actuation of the pump in a dispensing stroke to alter the volume of the chamber, wherein the flexible wall comprises a plurality of facets at least one of which is interrupted by a curved surface portion inclined to the facet and intersecting it along a boundary - normally a concave boundary -of the facet so as to induce bending of the facet when the wall is flexed on actuation of the pump, thereby producing a force tending to restore the flexible wall to the rest condition. Preferably each facet is interrupted by a respective such curved surface, these surfaces being distributed extending radially from a rigid central part, integral with the flexible wall, out into their respective facets.

A preferred formation of the flexible wall between its boundary portion and the central part is that generally of a polygonal pyramid, a preferred number of sides for the polygon being five. In that case, the facets are preferably angled at between 35° and 40° to the base plane of the polygon, more preferably at about 37½°. Furthermore, to provide improved flexion characteristics and in particular an improved restoring force, the curved surface may interrupt the facet at a radially inner portion thereof and be a cylindrical surface portion, the cylindrical surface being intersected by a plane of the facet. The vertical plane of projection of the axis of the cylinder is preferably coincident with the median line of the respective facet and includes the displacement axis of ther flexible wall. The facets are preferably planar in the rest condition. The preferred angle of intersection in the rest position is of the order of 20° to 25°, more preferably 22½°, so that the angle of the axis of the cylinder portion to the plane of the base of the polygon is most preferably about 60°.

When the wall of this conformation is fully depressed in a full dispensing stroke, the planar facets may pass to below the plane of the base of the polygon forming a negative angle therewith, but the cylindrical portions will remain substantially unflexed thereby rendering the formerly planar facets into a curved form and inducing a strong restoring force on the wall tending to urge it back to its original position. At the same time this preferred conformation enables a large volume change to be induced for a given diameter and a given length of stroke particularly when, as preferred, the displacement axis of the flexible wall coincides with the axis of the polygonal pyramid.

In a further aspect the invention provides a dispensing pump wherein a pump chamber has a volume which is alterable in a dispensing stroke by flexion of a wall of the chamber and wherein an inoperative condition of the dispenser pump to prevent discharge of material through it can be adopted, the inoperative condition being achieved by relative rotation of two body parts of the pump about an axis which is an axis of displacement of the wall during its flexion by actuating means in a dispensing stroke of the pump, this axis being defined by a telescopic guide means connecting between the body parts and having a first part secured to (and preferably integral with) the flexible wall and a second part secured to (also preferably integral with) a body part of the dispenser pump relative to which the flexible wall is displaced, this telescopic guiding connection having stop means permitting relative axial telescopic displacement of its parts in one position of relative rotation of the parts of the pump and preventing such movement in another condition of relative rotation. Furthermore a discharge nozzle of the pump integrally formed with the flexible wall is brought into register with an outlet port associated with an outlet valve means of the pump chamber only in that condition of relative rotation in which relative axial displacement of the telescopic parts is permitted. In other conditions of relative rotation the discharge nozzle and outlet port are axially but not circumferentially aligned. Additionally, if the dispenser pump is provided with a vent for displacement air to enter, that vent preferably includes a port, groove or the like in one of the two relatively rotatable parts of the body, the other part having a projection or other suitable blocking portion effective to block the port or groove in the position of relative rotation of the parts in which relative movement of the telescopic parts is prevented. The problem of leakage in storage or transit may therefore be solved.

The invention in any of its aspects (which are preferably combined) may further allow for the protection of the flexible wall by the securing to an actuating part integral therewith of a protective cap having a cover part and a skirt, the skirt being adapted and dimensioned to extend downwardly around the flexible wall part and to abut upon a full stroke of displacement of the two parts upon the body part. To provide further protection against accidental discharge during transport or storage and also to provide an indication of any tampering with the pump, the protective cap may be maintained in a position of maximum separation from the body by the provision as an extension of the skirt of a tear-off strip abutting against the body thereby preventing, until torn away, any downward displacement of the cap.

The body part comprising the flexible wall on the one hand and that comprising the fixed body part are preferably both one-piece integral moulded parts of plastic materials. Additional elements may be balls or the like to form inlet and outlet unidirectional valves for the pump chamber, the protective cap and a suction tube for attachment to the pump to reach into a container to which it is to be fitted.

Furthermore, the body part may provide an annular channel for the reception of the mouth of a container, the channel comprising stop means for preventing relative rotation of the body part and the container. Alternatively the same channel may be provided with an adaptor member having a skirt tightly fitting within the channel and an outwardly directed flange adapted to be entrapped upon the neck of a container by the screwing down or otherwise securing of a flanged ring onto that neck.

BRIEF DESCRIPTION OF THE DRAWINGS

Particular embodiments of the invention will now be described by way of example with reference to the accompanying drawings wherein:

FIG. 1 is a plan view of a first embodiment in an actuatable, operating, condition;

FIG. 2 is a section on the line A—A of FIG. 1;

FIG. 3 is a section on the line B—B of FIG. 1;

FIG. 4 is a fragmentary section on the line D—D of FIG. 3;

FIG. 5 is a section on the line C—C of FIG. 2;

FIG. 6 is an exploded perspective view of two parts of a telescopic guide stem;

FIG. 7 is a top view on the flexible wall of FIGS. 2 or 3;

FIG. 8 is a section analogous to FIG. 2 through a modified embodiment;

FIGS. 10*a* & *b* show in diagrammatic section two conditions of the flexible wall of the embodiments.

DETAILED DESCRIPTION OF PREFERRED EMBODIMENTS

Figure 9:
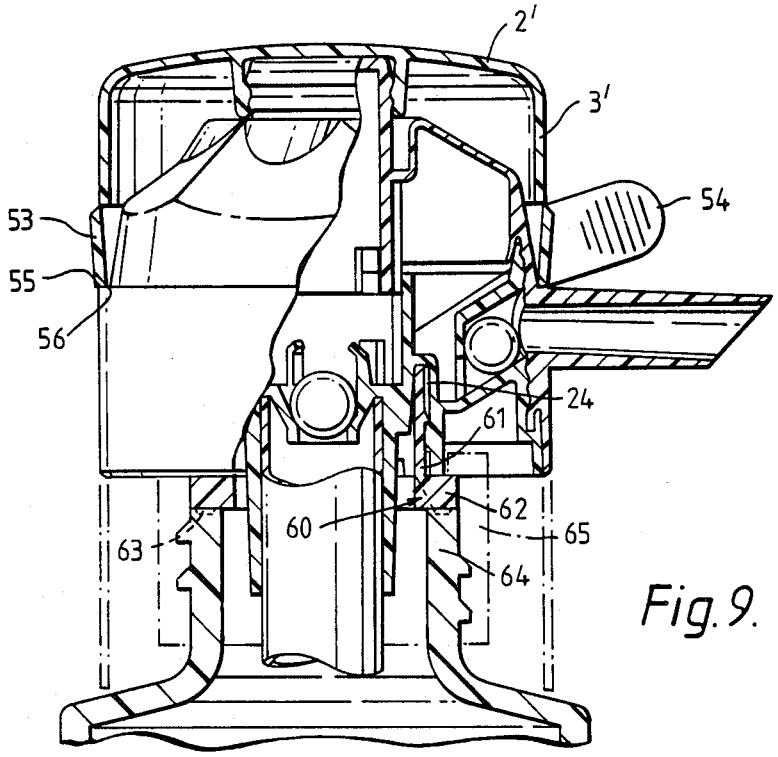
FIG. 9 is a section analogous to FIG. 2 through a second modified embodiment.

Referring first to FIGS. 1 to 7, the dispenser pump has a protective cap 2 which includes a skirt 3.

Internally it has a downwardly opening cup 4 the inner surface of which is for engagement with a first outer body part 1 of the pump, specifically with the head 5 of a rigid first cylindrical part 6 of an axially telescopic construction. The part 6 is integral through a flange 7 and thinner wall 8 with a flexible wall 9 to be described in more detail later. The wall 9 is generally in the form of a downwardly directed conical polygon, or polygonal pyramid, and is integral with a substantially rigid outer cylindrical wall 10, slightly tapering upwardly, penetrated at one position on its circumference by a port 11 leading to a discharge nozzle 12. On its inner periphery the wall 10 is circumferentially grooved as at 13 to engage closely with the similarly circumferentially grooved peripheral wall 14 of a rigid second, minor, pump body part generally designated 15. At the top and the bottom of this wall 14 interleavings 16,17 provide an effective fluid seal between the two walls 14,10. The circumferential groovings 13 mate together and are continuous around the walls so that they permit relative rotation of them about the central axis of the cylindrical post 6 and of the telescopic construction of which it forms part.

The other part of that telescopic construction is provided by an upwardly projecting inner cylinder 20 of the body part 15, linked to the outer wall 14 of the body part through a base wall 21 and a skirt 22 which between itself and a central boss 23 of the body part forms an upwardly tapering and downwardly opening channel 24 for the reception of a container mouth or of an adaptor as will be more fully described. Since the body part 15 and the wall elements of the outer body part 1 are together fluid-tight they form between them a pump chamber 25 the volume of which is alterable if the flexible wall 9 is depressed downwardly and released to move upwardly.

This alteration in volume can exert a pumping action because of the presence of unidirectional valves 26,27 which are respectively inlet and outlet valves. Both valves are formed by balls, the inlet valve 26 by a ball forced into a cage 28 past trapping legs 39 to fall into a seat at the bottom of the cage, and in the case of the outlet valve by a ball placed in an outlet port 29 and seating on the one hand against the upper surface of the bottom wall 21 of the chamber and on the other hand against an inner wall of that port. The steep inclination of the lower wall 21 keeps the ball biased against the inner wall of the port in which position it prevents ingress of material through that port.

Registering notches 30 and 31 are provided in the telescopic parts 6 and 20 respectively, so that material to be dispensed can pass from the inlet valve 26 inside the telescopic construction through the opposed notches 30,31 and out into the pump chamber 25.

In FIG. 3, taken in a different plane to FIG. 2, it can be seen that at the bottom of the skirt 22 is a notch 32 which is intended to engage with a pip or lug on the shoulder of a container to which the pump is fitted in order to prevent rotation of the inner body part 15 relative to that container. FIG. 3 also shows a displacement air port 33 extending from an aperture in the wall 14 to a duct 34 within the thickness of the wall of the central tubular boss 23 of the second body part 15 and opening at the bottom of the pump i.e. into a container where one has been fitted. In the operating condition of the pump, as will be described, the port 33 is in register with an axially directed groove 35 formed on the inner periphery of the wall 10 of the outer body part 1, thus setting up a channel for air to vent inwardly from the ambient atmosphere to the interior of a container on which the dispenser pump may be fitted.

By virtue of the construction of the two body parts 1,15 of the pump they may, when the flexible wall is in the relaxed or rest condition seen in FIGS. 2 and 3, be turned through 90° relative to each other about the central axis of the telescopic construction connecting and guiding them together at the center. In the operative relative rotational position the condition is as seen in FIGS. 2 and 3 with the inner port 11 of the discharge nozzle 12 in register with the outlet port 29 of the pump chamber, and with the axial groove 35 in register with the displacement air port 33 to make the venting channel. Also in that condition as can be best seen in FIGS. 5 and 6, an axially extending outward rib 40 extending down the upper telescopic part 6 is brought into register with an axially extending groove 41 in the lower, inner telescopic cylinder 20. Joining the head of the groove 41 at the upper opening of the cylinder 20 is a groove 42 that extends partially around the inner periphery thereof so as to subtend an arc of 90° at the central axis of these parts. In the outward condition of the flexible wall 9 the bottom of the rib 40 fits within the peripheral groove 42 while being clear of the top of the axial groove 41, so that relative rotation of the two parts is permitted with the bottom end of the rib 40 sliding in the peripheral groove 42. The walls forming the ends of the peripheral groove 42 act as stops limiting the possible rotational movement of the body parts relative to each other to 90° of arc.

As best seen in FIG. 4, on the inner surface of the outer wall 10 of the upper body part 1, at 90° from the displacement air groove 35, is a projection in the form of a bump or pip 43.

When it is desired to lock up the pump in order for example for it to be transported on a loaded container, the outer body part 1 is rotated through 90° relative to the inner body part 15, rotation being anti-clockwise as seen for example in FIGS. 5 and 6 (FIG. 4 is an underneath section so apparent orientations are reversed). This rotation of 90°, delimited by an end wall of the slot 42, has the effect of swinging the discharge nozzle 12 such that its inner port 11 is 90° away from the outlet port 29 of the pump chamber, and of bringing the bump 43 into register with the vent port 33, sealing that up. It also means that because the bottom of the rib 40 is not in register with the axial groove 41, no depressive movement of the flexible wall is possible.

In FIG. 8 a modification is shown where instead of a cap 2 being fitted on a ribbed head of the top cylindrical part 6, this portion (now designated 6') is provided with a rigid upper part 50 and a dished head 51 able to be used directly for finger or thumb depression by the user. The other parts of the embodiment are as previously described.

In the modification seen in FIG. 9, the skirt 3' of the protective cap 2' is modified by the addition of a tear-off strip 53 provided with a pull tab 54. The height of the tear-off strip is such that its bottom edge 55 abuts against a ledge 56 on the inner body, thereby while remaining in position providing a further obstacle to depression of the outer body relative to the inner body. Once the pull tab has been torn away it of course shows that the contents of any container to which the pump is attached may have been tampered with. Its removal will however permit depression of the cap 2' if so wished, subject to the pump being in its operative condition.

FIG. 9 also shows how the dispenser pump need not be fitted directly upon the mouth of a container by the fitting of the latter directly into the downwardly opening channel 24, but instead by means of an adaptor 60 comprising a skirt part 61 for engagement into the channel 24, and a flange part 62 which may be provided with a pip or lug for engagement with the notch 32 in the skirt 22 and which furthermore may have pips or spikes 63 for frictional engagement with the extreme end of a mouth 64 of a conventional bottle. A standard closure for such a bottle comprises a skirt or collar 65 with an internal screw thread or clip-on securing to the bottle mouth, and an in-turned top flange for overlying the outer portion of the adaptor flange 62.

The conformation of the flexible wall 9 is an aspect of the invention. As best seen in FIG. 7, the wall 9 is preferably a polygonal pyramid, the number of facets 70 preferably being five. In the rest (upwardmost) condition of the wall 9 the facets 70 are planar and are at an angle of between 35° and 40° to the plane common to their bases, a most preferred angle is 37½°. Each facet is intersected along a concave boundary at a radially inner part thereof by a cylindrical surface portion 71 the central line of which lies in the same radial plane of the pyramid as does the centre line of each facet; this is best indicated by the construction line 73. The angle of intersection of each cylinder part with each facet is preferably in the range 20°–≅° so that the centre line e.g. 73 of each cylindrical part is at an angle in the range 55°–65°, preferably 60°, to the common plane of the bases of the facets. This is perhaps seen most clearly in FIG. 10*a* FIG. 10*b* shows the position of these facets and cylindrical parts when the wall 9 is in its fully deflected downward condition. Here the facets 70 have passed through the plane of the base of the flexible wall and are now at a negative cone angle, while the cylindrical surface parts remain substantially undeflected. This renders the formerly planar facets curved and imposes a strong restoring force on the wall tending to urge it back towards its upward condition.

This construction and angles are particularly suitable for formation of the flexible wall in polypropylene integrally with the cylindrical guide part and the outer wall 10 as well with the discharge nozzle 12 and vent groove 35 on that wall 10.

Figure 11:
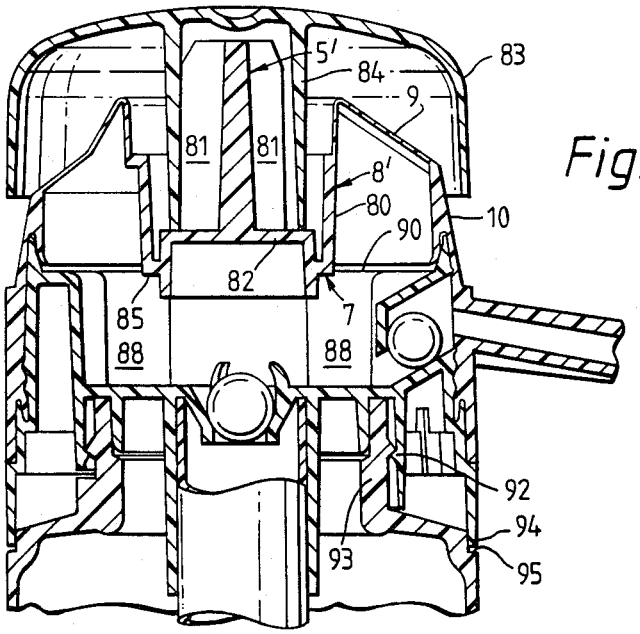
FIG. 11 is a diametrical section through an assembled third modified dispenser.

In the modification shown in FIG. 11 are advantageous constructions for assuring the guidance and locking of the body and upper parts and also for assuring gas communication between the upper and lower portions of the pump chamber.

In this modification, which is seen assembled in FIG. 11, the flexible wall 9 and rigid outer wall 10 are substantially as before.

Figure 12:
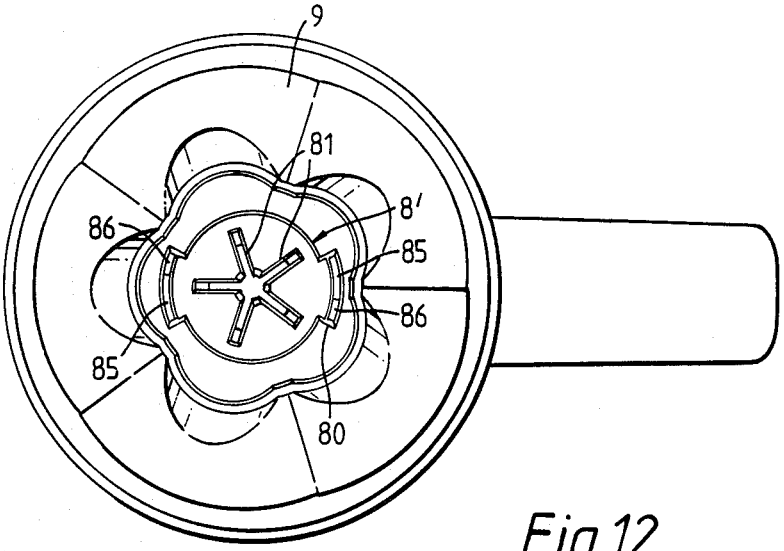
FIG. 12 is a plan view of the upper body part of the dispenser.

The wall 8' of the depression in the top of the flexible wall 9, as can best be seen from the plan view of FIG. 12, includes two divergent dovetail axially extending projections 80, projecting radially outwardly into the pump chamber. The head part 5' is modified to be formed as five equiangularly spaced radial walls 81 projecting upwardly from a floor 82 which closes off the upper body part in the center of the flexible wall.

A cap 83 has an internal cylindrical skirt 84 which is a tight interference fit with the outer edge surfaces of the walls 81 as it is forced downwardly over them.

The downwardly facing bottom end surface 85 of each of the dovetail projections 80 has a portion 86, occupying about a third of the total length of the bottom end surface, which is outwardly chamfered at about 45°.

Figure 13:
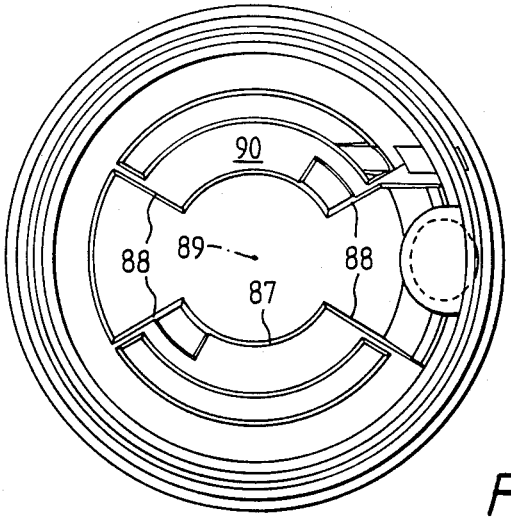
FIG. 13 is a plan view of the lower body part of the dispenser of FIG. 11.

The lower body part into which the upper body part fits is seen in plan view in FIG. 13, and is generally similar to that previously described except that the wall 8' is received in a cylindrical well 87 which has in diametrically opposed sides of it cut-outs defined by radial walls 88, the angular extent of the cut-outs being just slightly greater than the angular extent of the projections 80 on the stem 8'. For example those projections 80 may subtend an angle of 60° at the center of the stem while the cut-out walls 88 subtend angles of 62° at the same axis, indicated at 89 of FIG. 13. Thus the projections 80 may fit into the cut-outs and while so fitting guide the telescopic movement of the upper part relative to the lower.

In the relaxed condition of the flexible walls 9, the bottom ends 85 of the projections 80 come below the level 90 of the top of the lower body part and thus in principle relative rotation of the two would not be possible. However, because of the chamfering of the portion 86 of the bottom, which extends in the rest position to a level above that of the top 90 of the lower body part, when the upper part is in the condition seen in FIG. 11 it may be rotated clockwise relative to the lower body part as described for the previous embodiment, with the central guide of the upper body part being pushed slightly upwardly as its bottom projection surfaces 85 rise to the level 90. The limit of this rotational movement is defined by stops 91 on the upper surface 90 whose axial extent is greater than the axial extent of the chamfered portion 86.

It will be noticed that in this embodiment there is no problem of specially providing for communication between the upper and lower parts of the pump chamber since in the raised condition of the upper body part this is assured through the radially outer parts of the cut outs defined by the walls 88.

To unlock the device, the upper part is rotated anticlockwise, the flexible wall 9 recovering to urge the projections 80 downwardly into the cut-outs so that abutment of their end against the walls 88 in the anticlockwise direction will define the position from which an axial stroke may now be begun.

At its lower end FIG. 11 shows how a ledged skirt 92 may be designed for a snap fitting with a specially formed ledged neck 93 of a plastics or glass container, with a supporting and streamlining flush fitting of the outermost skirt 94 of the lower body into a recess 95 formed at the top of the wall of the container.

We claim:

1. A dispenser pump for dispensing material, the pump having:

(a) first and second body parts, one of the body parts comprising a flexible wall and an essentially rigid boundary portion thereof;

(b) a pump chamber between the body parts, the flexible wall at least partly defining the pump chamber;

(c) actuating means for displacing the flexible wall along a displacement axis in a dispensing stroke to alter the volume of the pump chamber, and (d) inlet and outlet valve means respectively for admission of material to and discharge of material from the pump chamber;

the flexible wall having a rest condition and comprising at least one facet having a concave boundary and a curved surface portion interrupting the facet for inducing bending of the facet in the dispensing stroke to produce a restoring force tending to restore the flexible wall to the rest condition, the curved surface portion being inclined to the facet and meeting it along the concave boundary.

2. A dispenser pump according to claim 1 wherein the flexible wall has substantially the shape of a polygonal pyramid with plural substantially planar facets.

3. A dispenser pump according to claim 2 wherein the pyramid is five-sided and comprises facets inclined to the pyramid base plane at an angle between 35° and 40° in the rest condition.

4. A dispenser pump according to claim 2 wherein each of the facets is interrupted by a respective said curved surface portion.

5. A dispenser pump according to claim 2 wherein the curved surface portion is a cylindrical surface portion.

6. A dispenser pump according to claim 5 wherein the cylindrical surface portion has an associated cylinder axis, which axis intersects its respective facet plane in the rest condition at an angle between 20° and 25°.

7. A dispenser pump according to claim 1 comprising a telescopic guide connected between the body parts;

said telescopic guide comprising first and second telescopic parts and stop means on said telescopic parts, the first telescopic part being on the flexible wall to be moveable therewith along the displacement axis thereof, and the second telescopic part being on the other body part and engaging the first telescopic part telescopically slidably;

said first and second body parts being relatively rotatable between a first relative rotational orientation wherein said stop means engage to prevent relative sliding of the telescopic parts, thereby providing an inoperative condition of the pump, and a second relative rotational orientation wherein the stop means are disengaged to allow such relative sliding and thereby provide an operative condition of the pump.

8. A dispenser pump according to claim 7, further comprising:

a vent channel for displacement air to enter during dispensing, the channel including a portion defined by one of the relatively rotatable body parts;

a groove and a projection on the other body part, the projection being angularly spaced from the groove, which extends to the pump exterior;

the groove being aligned with the channel portion of the one body part in the operative condition of the pump, whereby the vent channel is defined, and the projection being aligned with the channel portion in the inoperative condition of the pump, whereby the vent channel is blocked.

9. A dispenser pump according to claim 7 wherein said body part comprising the rigid boundary portion further comprises a discharge nozzle, and said other body part comprises an outlet port associated with the outlet valve means and axially aligned with the discharge nozzle, the outlet port being circumferentially aligned with the discharge nozzle to communicate therewith only in the operative condition of the pump.

10. A dispenser pump for dispensing material, the pump comprising:

(a) first and second body parts;

(b) a flexible wall;

(c) an essentially rigid boundary portion of the flexible wall;

(d) a pump chamber between the body parts, the flexible wall at least partly defining the pump chamber;

(e) actuating means for displacing the flexible wall along a displacement axis in a dispensing stroke to alter the volume of the pump chamber;

(f) essentially rigid guide means on the flexible wall and movable therewith to guide the movement thereof along the axis of displacement;

(g) inlet and outlet valve means respectively for admission of material to and discharge of material from the pump chamber, and (h) a projecting discharge nozzle for material dispensed through the outlet valve;

one of the body parts comprising the flexible wall, boundary portion, guide means and discharge nozzle as a one-piece integral part of one material.

11. A dispenser pump according to claim 10 comprising a vent channel for displacement air, and wherein the one-piece integral body part further comprises a portion defining at least part of the vent channel.

12. A dispenser pump according to claim 10 wherein the material of the one-piece part is polypropylene.

13. A dispenser pump according to claim 10 wherein the flexible wall has a rest condition and comprises at least one facet having a concave boundary and a curved surface portion interrupting the facet for inducing bending of the facet in the dispensing stroke to produce a restoring force tending to restore the flexible wall to the rest condition, the curved surface portion being inclined to the facet and meeting it along the concave boundary.

14. A dispenser pump according to claim 13 wherein the flexible wall has substantially the shape of a polygonal pyramid with plural substantially planar facets.

15. A dispenser pump according to claim 10 wherein the other one of said body parts comprises seatings of said inlet and outlet valve means, a rigid outer wall fitting with the essentially rigid boundary portion of the flexible wall to form the pump chamber between the two body parts, and a guide part slidably engaging the guide means on the flexible wall, said other body part comprising said seatings, outer wall and guide part together as a one-piece integral part of one material.

* * * * *